US012687101B1

(12) United States Patent
Johnson et al.

(10) Patent No.: US 12,687,101 B1
(45) Date of Patent: Jul. 21, 2026

(54) IDENTIFICATION AND MITIGATION OF WHIRL WITHIN A DRILLING SYSTEM

(71) Applicant: Schlumberger Technology Corporation, Sugar Land, TX (US)

(72) Inventors: Ashley Bernard Johnson, Cambridge (GB); Spyridon Joseph Kotsonis, Sugar Land, TX (US); Ross Lowdon, Stonehouse (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/272,319

(22) Filed: Jul. 17, 2025

(51) Int. Cl.
*E21B 44/08* (2006.01)
*E21B 12/00* (2006.01)

(52) U.S. Cl.
CPC ..... *E21B 44/08* (2013.01); *E21B 12/00* (2013.01)

(58) Field of Classification Search
CPC ..... E21B 44/08; E21B 12/00
See application file for complete search history.

(56) References Cited

U.S. PATENT DOCUMENTS 9,410,377 B2 * 8/2016 Jain ..... E21B 10/00
10,215,010 B1 * 2/2019 Hadi ..... E21B 44/00
2015/0083493 A1 * 3/2015 Wassell ..... E21B 44/00 702/9
2016/0032658 A1 * 2/2016 Jain ..... E21B 17/1014 175/27
2019/0323335 A1 * 10/2019 Ocegueda-Hernandez ..... E21B 44/04
2020/0011751 A1 * 1/2020 Kazemi Miraki .... E21B 47/024
2020/0386055 A1 * 12/2020 Chen ..... G06F 30/17
2021/0131197 A1 * 5/2021 Panayirci ..... E21B 17/1078
2021/0324726 A1 * 10/2021 Mahajan ..... E21B 10/43
2022/0025755 A1 * 1/2022 Chen ..... E21B 45/00
2023/0086947 A1 * 3/2023 Rector ..... E21B 49/006 175/24
2024/0044210 A1 * 2/2024 Belaskie ..... E21B 45/00
2026/0071536 A1 3/2026 Johnson
2026/0071537 A1 3/2026 Johnson

OTHER PUBLICATIONS

Agarwal , V., et al., "Noise-assisted response steering for a rotor-stator system", Journal of Sound and Vibration, Jan. 1, 2022, pp. 1-14, vol. 523.
Pastusek, P., "Stabilizer Selection Guidelines", ExxonMobil, Jun. 15, 2015, pp. 1-19.

* cited by examiner

*Primary Examiner* — Yanick A Akaragwe
(74) *Attorney, Agent, or Firm* — Kyle R. Miiller

(57) ABSTRACT

Whirl in a drilling system may be identified and mitigated by monitoring signals from a plurality of sensors positioned at various axial locations along a drill string of the drilling system, determining a respective frequency component and a respective amplitude component for each of the signals, identifying whirl in the drill string based on at least two of the respective frequency components and their respective amplitude components, and mitigating the whirl by introducing noise into the drilling system to reduce or eliminate the whirl without removing the drill string from a bottom of a borehole and without terminating all rotation of the drill string.

18 Claims, 7 Drawing Sheets

IDENTIFICATION AND MITIGATION OF WHIRL WITHIN A DRILLING SYSTEM

BACKGROUND

The present disclosure generally relates to systems and methods for identifying and mitigating whirl within a drilling system.

Certain components of a drilling system may be subject to whirl. Whirl is characterized by circular movement or precession of rotating component(s), which may cause significant lateral (e.g., side-to-side) movement. Forward whirl occurs when the rotating component(s) move or precess in the direction of rotation, and backward whirl occurs when the rotating component(s) move or precess in an opposite direction to the direction of rotation of the rotating component(s). During a drilling process, backward whirl may cause frequent contact between a bottomhole assembly (BHA) and the borehole, thereby increasing wear on the downhole drilling tool(s) of the BHA and/or increasing bending loads. Whirl (e.g., backward whirl) may also lower the rate of penetration (ROP) and decrease drilling efficiency.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain embodiments, a system includes a plurality of sensors placed at various axial positions on a drill string and configured to output respective signals indicative of movement of the drill string, and one or more controllers communicatively coupled to the plurality of sensors. The one or more controllers are configured to identify whirl in the drill string based on the respective signals from the plurality of sensors. The one or more controllers are further configured to control a downhole component, a surface component, or a combination thereof, in response to identifying the whirl, to introduce noise into the drill string to mitigate the whirl without removing the drill string from a bottom of a borehole and without terminating all rotation of the drill string.

In certain embodiments, a method is provided for identifying and mitigating whirl within a drilling system. The method includes monitoring signals from a plurality of sensors positioned at various axial locations along a drill string of the drilling system, determining a respective frequency component and a respective amplitude component for each of the signals, and identifying whirl in the drill string based on at least two of the respective frequency components and their respective amplitude components. The method further includes mitigating the whirl by introducing noise into the drilling system to reduce or eliminate the whirl without removing the drill string from a bottom of a borehole and without terminating all rotation of the drill string.

The brief summary presented above is intended only to familiarize the reader with certain aspects and contexts of embodiments of the present disclosure without limitation to the claimed subject matter.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
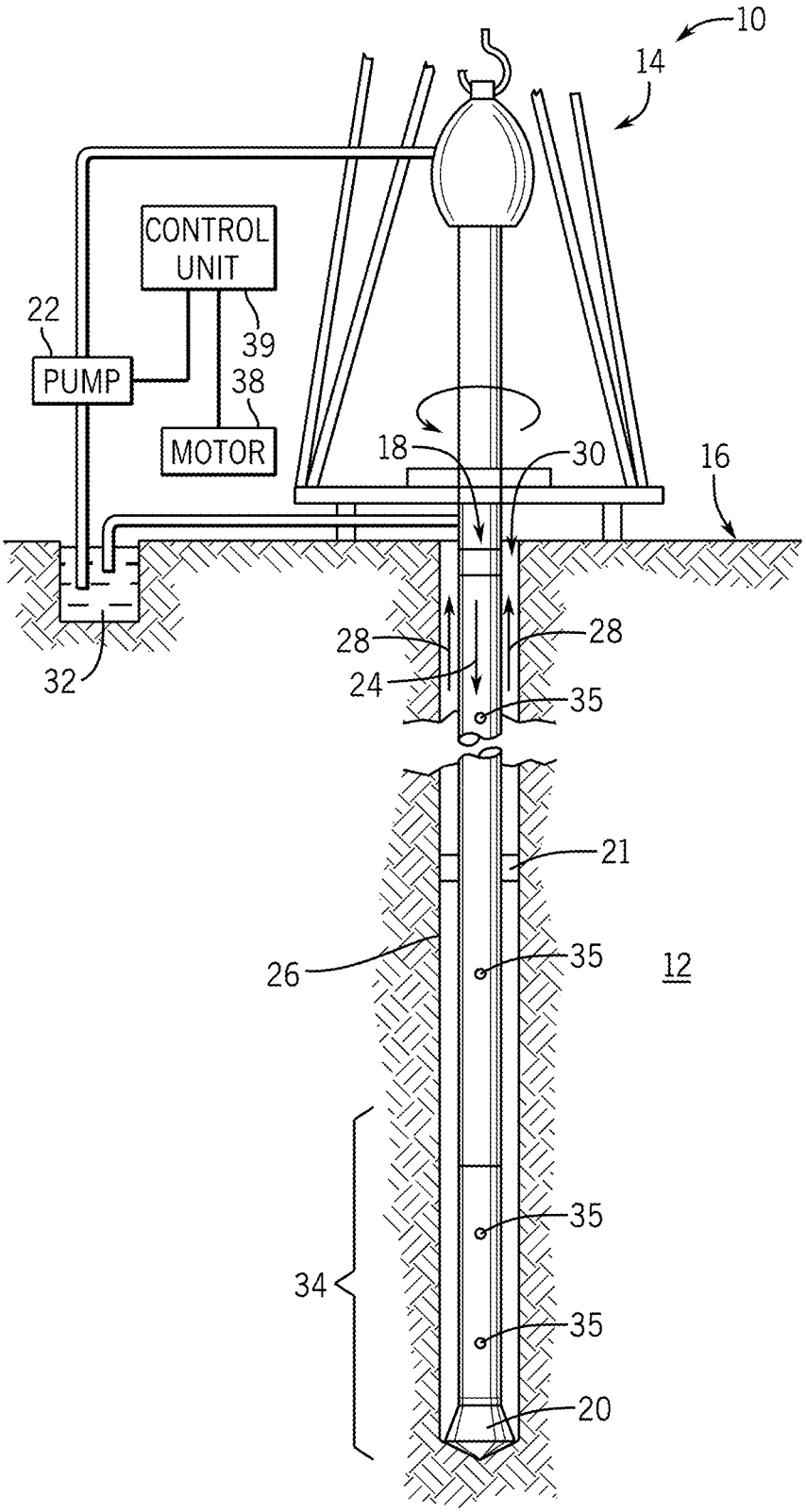
FIG. 1 is a schematic view of an embodiment of a drilling system, in accordance with aspects of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection (e.g., where the connection may not include or include intermediate or intervening components between those coupled), and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an embodiment," or "some embodiments" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

The present disclosure generally relates to identifying or detecting whirl within a drilling system and mitigating the whirl by adding noise to the drilling system in response to detection of the whirl. In certain embodiments, the whirl may be identified or detected by monitoring lateral accelerations at different axial positions along a drill string and/or a bottomhole assembly (BHA), determining the frequency and the amplitude of oscillation at each axial position based on the respective lateral accelerations, and comparing the frequencies with one another. If the frequency difference is greater than a threshold frequency and each amplitude is greater than a threshold amplitude, whirl is identified or detected, and mitigation procedures may be recommended or automatically performed. Such mitigation procedures generally include introducing "noise" into the drilling system in a manner that tends to disrupt the whirl and to bring the frequency difference and amplitudes into a more acceptable range. The introduction of noise into the drilling system may occur in several ways including, but not limited to, perturbing flow rate of fluid, modulating mud pumps and/or bypass flow, altering motor speed to change the rotary speed of the drilling system, altering weight on bit (WOB), controlling friction pads on the BHA, etc., or any suitable combination of such techniques. Further, the introduction of noise into the drilling system can be accomplished and/or controlled from the surface or using a closed-loop downhole control. Such noise introduction is typically short term for the purpose of disrupting the detected whirl, then the drilling system is returned to normal operation. Also, the mitigation techniques described herein do not involve removing the drill string from the bottom of the borehole along with stopping all rotation of the drill string. Rather, the mitigation techniques described herein allow the drill string to remain in proper position for continued drilling operations by performing short term perturbations to the drill string that introduce noise effective for reducing or eliminating any undesirable whirl.

With this in mind, FIG. 1 is a schematic view of an embodiment of a drilling system 10 (e.g., subterranean drilling system) that may be used to drill a well through a subterranean formation 12 to extract various fluids (e.g., oil, natural gas, or hydrocarbon containing fluids). In the illustrated embodiment, a drilling rig 14 at the surface 16 may rotate a drill string 18, which includes a drill bit 20 at its lower end to engage the subterranean formation 12. The drilling system 10 is configured to rotate the drill bit 20 to cut a vertical borehole 26 in the subterranean formation 12, and in certain embodiments, the drilling system 10 is configured to steer the drill bit to cut a curved and/or lateral borehole in the subterranean formation 12. The drill string 18 may include one or more stabilizers 21 positioned at one or more locations along the drill string 18. Such stabilizers 21 are generally intended to maintain the axial position of the drill string 18 within the borehole 26. However, depending on a variety of factors (e.g., length of each section of the drill string 18 between stabilizers 21, rotational speed of the drill string 18, dynamics of the drill string 18 and/or other components of the drilling rig 14, etc.), different sections of the drill string 18 may oscillate at different frequencies and different sections of the drill string 18 may or may not exhibit whirl at any given time. As described below, it may be useful to monitor oscillations of the drill string 18 at various locations to determine the state of different sections of the drill string 18.

To cool and/or lubricate the drill bit 20, a drilling fluid pump 22 may pump drilling fluid 28, commonly referred to as "mud" or "drilling mud," from a mud pit 32, downward through the center of the drill string 18 in the direction 24 to the drill bit 20. In addition to cooling and lubricating, as discussed in further detail below, the drilling fluid 28 may also facilitate the drill bit 20 turning and cutting the curved borehole. At the drill bit 20, the drilling fluid 28 may exit the drill string 18 through ports (not shown) and flow into the borehole 26. While drilling, the drilling fluid 28 may be pushed toward the surface 16 through an annulus 30 between the drill string 18 and the formation 12, thereby carrying drill cuttings away from the bottom of the borehole 26. Once at the surface 16, the returned drilling fluid 28 may be filtered and conveyed back to the mud pit 32 for reuse. Additionally, the drilling fluid 28 may exert a mud pressure on the formation 12 to reduce likelihood of fluid from the formation 12 leaking into the borehole 26. As discussed below, the pump 22 may be controlled to alter the flow of drilling fluid 28 in such a way as to disrupt any sensed whirl.

Further, the drill string 18 includes a bottom hole assembly (BHA) 34 having various components, such as the drill bit 20, that operate together, as discussed in further detail below with reference to FIGS. 2 and 3. It should be appreciated that the drilling system 10 includes a motor 38 that is configured to rotate the drill string 18, and thus the BHA 34. The motor 38 may also be configured to drive the pump 22, although the pump 22 may be driven separately by its own motor (not shown). As discussed above, rotation of the drill string 18 and BHA 34 can induce whirl in one or more segments of the drill string 18 and/or BHA. Indeed, although the BHA 34 is illustrated as being relatively short compared to the drill string 18, it should be appreciated that the various components of the BHA 34 may still be placed far enough apart such that one or more portions of the BHA 34 can experience whirl.

To monitor the drill string 18 and BHA 34 for whirl, sensors 35 may be placed on or near various portions of the drill string 18 and/or BHA 34. Such sensors 35 may be any suitable sensor, e.g., accelerometers, gyroscopes, etc., that may be used to detect vibrations, oscillations, lateral accelerations, rotational speed, etc. The amplitudes and frequencies detected by the sensors 35 may be used in various ways as discussed in detail below to determine whether whirl exists in any of the components of the drill string 18 and/or BHA 34. If whirl is detected, the extent of the whirl may be determined, e.g., compared to one or more thresholds, so that mitigation procedures can be initiated in certain circumstances.

The drilling system 10 may further include a control unit 39 that controls the operation of the motor 38 and the pump 22. It will be appreciated that although a single control unit 39 is illustrated as controlling the motor 38 and the pump 22, the motor 38 and the pump 22 can be alternatively controlled by respective control units. As discussed below, the control unit 39 (or separate control units) may receive signals from the sensors 35 to determine whether whirl exists and/or to control various components of the drilling rig 14 to induce noise into the drill string 18 to disrupt any sensed whirl.

As discussed above, the drilling system 10 may be configured with a BHA 34 to steer the drill bit 20 to cut a curved or an arc shaped path, for example, to reach subterranean resources that are not located directly below the drilling rig 14. FIG. 2 is a schematic view of an embodiment of a BHA 34 that may be employed within the drilling system of FIG. 1 to perform such a task. As illustrated, the BHA 34 includes a reamer 50 coupled to a rotary steerable system (RSS) tool 64. The RSS tool 64 includes the drill bit 20 and a steering pad assembly 54. The drill bit 20, the steering pad assembly 54, and the reamer 50 provide a relatively compact arrangement of three points of contact 58, 60, 62 for defining an arc shaped profile 56 for drilling. In the illustrated embodiment, the first point of contact 58 is axially centered along the drill bit 20, the second point of contact 60 is axially centered along the steering pad assembly 54, and the third point of contact 62 is axially centered along the reamer 50. The RSS tool 64 is coupled to the reamer 50, which has a larger cutting diameter than the drill bit 20. Additionally or alternatively, the RSS tool 64 is configured to cut a pilot hole 68 for the borehole 26 by utilizing the drill bit 20 to engage with and drill through the subterranean formation 12. In cutting the pilot hole 68 for the borehole 26, the RSS tool 64 enables the reamer 50 to follow behind the RSS tool 64 and open the pilot hole 68 into a larger diameter borehole 26. In the illustrated embodiment, the drill bit 20, the steering pad assembly 54, and the reamer 50 each provide a point of contact with either the pilot hole 68 or the borehole 26. As discussed below, altering the WOB may affect these points of contact to induce noise into the drill string 18 to disrupt any sensed whirl.

As shown, the RSS tool 64 is configured to rotate with the drill string 18 and the drill bit 20, and as the RSS tool 64 rotates, steering pads of the steering pad assembly 54 are actuated to steer and direct the drill bit 20. Actuator(s) of the steering pad assembly 54 are configured to radially extend and radially retract individual steering pads of the steering pad assembly 54 as the steering pad assembly 54 rotates as part of the RSS tool 64, and as an individual steering pad is radially extended, the steering pad contacts a wall of the pilot hole 68 cut by the drill bit 20. The contact between the individual steering pad and the pilot hole 68 acts as the second point of contact 60 defining the arc shaped profile. Additionally, the reamer 50 is configured to follow the path cut by the drill bit 20 and cut the borehole 26 to a larger diameter suitable for producing resources. As discussed below, the steering pads of the steering pad assembly 54 may also be extended or retracted to induce noise into the drill string 18 to disrupt any sensed whirl.

The reamer 50 is coupled to the RSS tool 64 and a shaft (e.g., collar) of the drill string 18. The reamer 50 is a cutting structure configured to open or dress the pilot hole 68 into the borehole 26. The reamer 50 is fixed to the shaft (e.g., collar) of the drill string 18 and the RSS tool 64. Thus, the reamer 50 and the RSS tool 64 are configured to rotate directly with rotation of the shaft (e.g., collar) of the drill string 18. The reamer 50 includes a stabilizer portion 52 and a cutter portion 66. The stabilizer portion 52 includes an outer circumferential surface (e.g., stabilizer surface) with a smaller diameter than the diameter of the outer circumferential surface (e.g., cutter surface) of the cutter portion 66 of the reamer 50, such that the cutter portion 66 radially protrudes relative to the stabilizer portion 52. It should be appreciated that various portions of the BHA 34 may or may not rotate separately from the drill string 18 or from one another. Accordingly, if oscillations in the drill string 18 are detected, as described below, such oscillations may be similar for components that are rotating with the drill string 18 and may be different for components rotating separately from the drill string 18.

Figure 2:
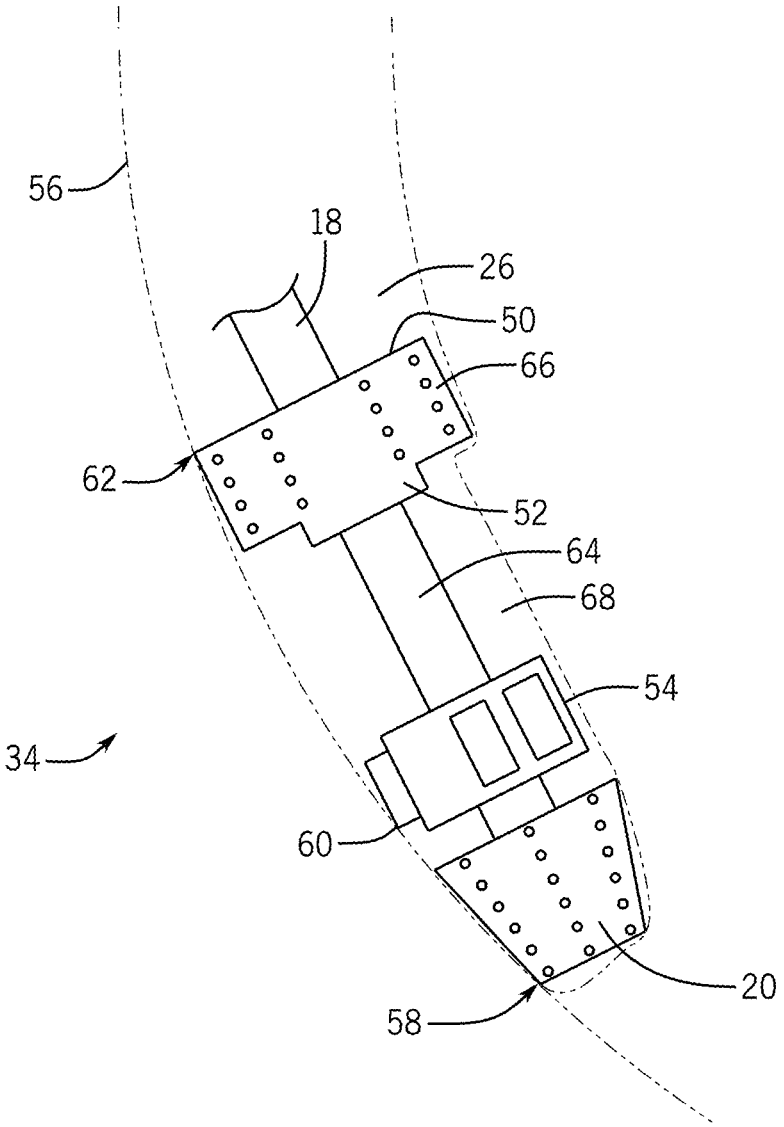
FIG. 2 is a schematic view of an embodiment of a bottomhole assembly (BHA) that may be employed within the drilling system of FIG. 1, in which the BHA includes a reamer coupled to a rotary steerable system (RSS) tool, in accordance with aspects of the present disclosure.
Figure 3:
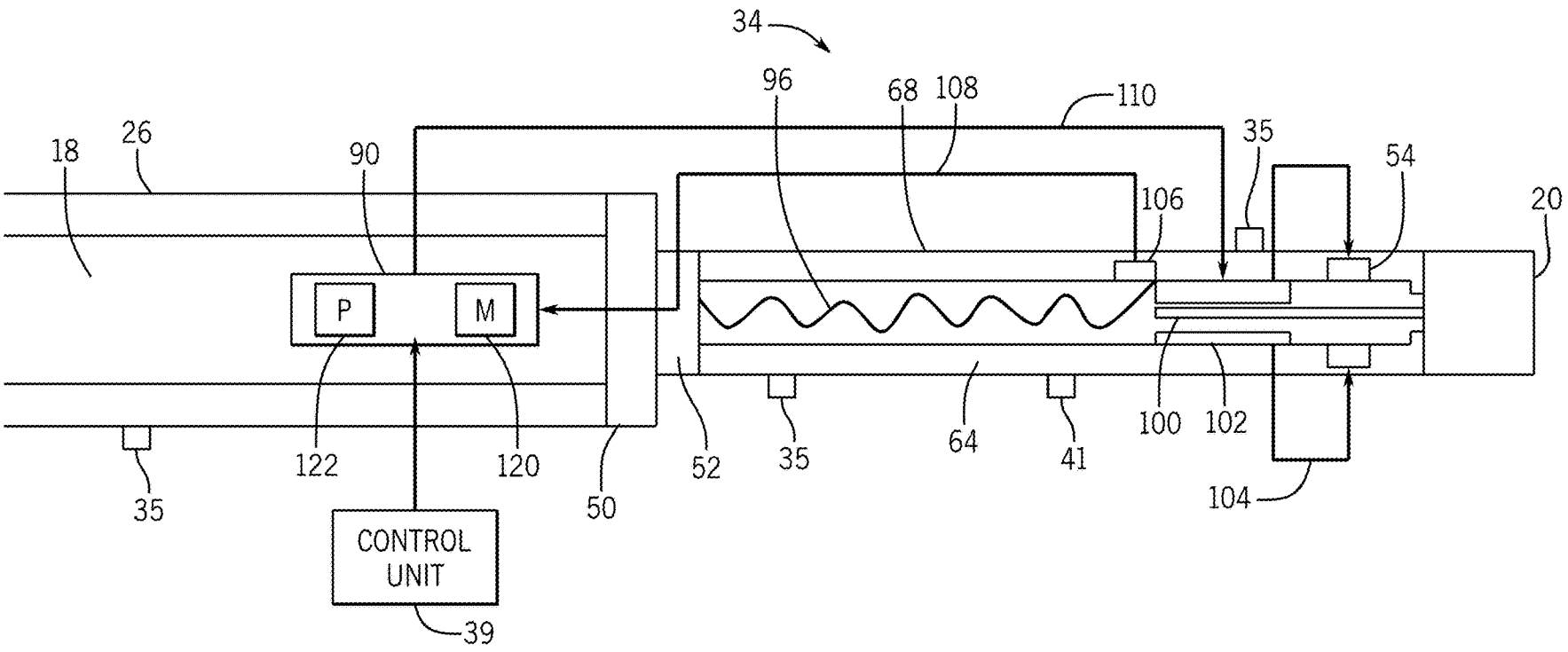
FIG. 3 is a schematic view of the RSS tool and the reamer of FIG. 2, in accordance with aspects of the present disclosure.

FIG. 3 is a schematic view of the BHA 34 of FIG. 2. In the illustrated embodiment, the RSS tool 64 is coupled to the reamer 50, which in turn is coupled to the shaft (e.g., collar) of the drill string 18. The BHA 34 includes a steering control unit 90 that is communicatively coupled to mud control valves 102 in the RSS tool 64 and configured to control the mud control valves 102 to facilitate steering operations performed by the RSS tool 64. The steering control unit 90 includes a processor 122 and a memory 120, where instructions stored on the memory 120 and executable by the processor 122 may control various components of the RSS tool 64. In the illustrated embodiment, the steering control unit 90 is communicatively coupled to a forward sensor package 106, to the mud control valves 102, and to the control unit 39 located on the surface 16. The steering control unit 90 receives input data/signals from the control unit 39 and sensor data 108 from the forward sensor package 106, and based on these received data and signal, outputs data/control signals 110 to the mud control valves 102 to facilitate steering of the RSS tool 64, as the mud control valves 102 control the steering pads of the steering pad assembly 54.

In the illustrated embodiment, the mud control valves 102 are fluidly coupled to steering pad actuators 104 of the steering pad assembly 54. The steering pad assembly 54 rotates with the drill bit 20, and the steering pad actuators 104 are configured to actuate the steering pads of the steering pad assembly 54, such that the steering pads may radially extend and radially retract during operation. The mud control valves 102 are configured to provide the drilling fluid to the steering pad actuators 104 via fluid lines. For example, each mud control valve 102 may be fluidly connected to a respective steering pad actuator 104 of the steering pad assembly 54 via an individual pressurized mud line.

During steering and drilling operations, the steering control unit 90 is configured to receive sensor data 108 from the forward sensor package 106. In certain embodiments, the forward sensor package 106 includes one or more sensors configured to monitor operating parameters of the drilling fluid in the RSS tool (e.g., drilling fluid pressure, drilling fluid flow rate, etc.) during the drilling operation. The steering control unit 90 may receive these operational parameters and output these parameters to the surface control unit 39 so that the control unit 39 may make determinations regarding the manner in which the steering control unit 90 should control the RSS tool 64. In addition or alternatively, the steering control unit 90 may be configured to automatically adjust the various operating parameters based on sensor data 108 from the forward sensor package 106 during the drilling operation without input from the control unit 39. The BHA 34 may also include a measurement while drilling (MWD) modulator 41 that is typically used to convert electrical signals into mud pulses that are sent to the surface 16 to allow real-time monitoring and adjustments to the drilling trajectory.

Sensors 35 may also be placed at various locations along the drill string 18 and/or BHA 34. Such sensors 35 may be communicatively coupled to the control unit 39, the steering control unit 90 and/or a separate control unit (not shown) that may be located on the surface 16 or downhole near the BHA 34. These one or more control units may be programmed to process the signals from the sensors 35 to determine whether whirl exists. Additionally, as will be discussed below, certain techniques for inducing noise into the drill string 18 to disrupt whirl may be controlled by the control unit 39 at the surface 16 or controlled in a closed loop manner by the steering control unit 90 and/or one or more separate control units.

In certain embodiments, the RSS tool 64 may include a mud motor 96 and a transmission 100. The mud motor 96 may be an electric motor, a fluid-driven motor (e.g., driven by fluid flow of mud), or a combination thereof. In certain embodiments, the mud motor 96 is a fluid-driven motor having a shaft with a spiral or helical flighting disposed about the shaft. The mud motor 96 is configured to provide rotational energy to the drill bit 20 during drilling operations, such that the mud motor 96 may adjust (e.g., increase or decrease) drilling speeds independent of the rotation of the drill string 18 being provided by the motor 38. In this way, the mud motor 96 enables the drill bit 20 and RSS tool 64 to substantially reduce or eliminate overloading of the drill bit 20 in situations where the drill bit 20 diameter is significantly smaller than the reamer 50. Additionally or alternatively, the mud motor 96 may couple to the transmission 100, which is configured to receive rotational energy from the mud motor 96 and output rotational energy to the drill bit 20. For example, if during a portion of the drilling operation a higher relative torque and a lower relative rotational speed at the drill bit 20 is suitable for cutting through the subterranean formation 12, the transmission 100 may adjust the rotational energy output such that the torque is increased, thereby decreasing the rotational speed at the drill bit 20. Additionally or alternatively, if during an additional portion of the drilling operation a relatively higher rotational speed and a relatively lower torque at the drill bit 20 is suitable for cutting through the subterranean formation 12, the transmission 100 may adjust the rotational energy output such that the rotational speed is increased, thereby decreasing the torque at the drill bit 20. The transmission 100 may include gears and shafts of varying diameters and configurations, such that when these aforementioned adjustments are desired, the transmission 100 is configured to adjust a configuration of the gears and shafts to manipulate the output rotational energy profile from the mud motor 96 into an appropriate rotational energy profile at the drill bit 20. In certain embodiments, the mud motor 96 and the transmission 100 are controlled by the control unit 39 such that the user in the drilling and production facilities may output instructions to the mud motor 96 and the transmission 100. Furthermore, in certain embodiments, the mud motor 96 and the transmission 100 may be controlled by the steering control unit 90, and the parameters and configurations of the mud motor 96 and the transmission 100 may be dynamically adjusted in response to information from the sensor data 108 and/or the sensors 35.

Figure 4:
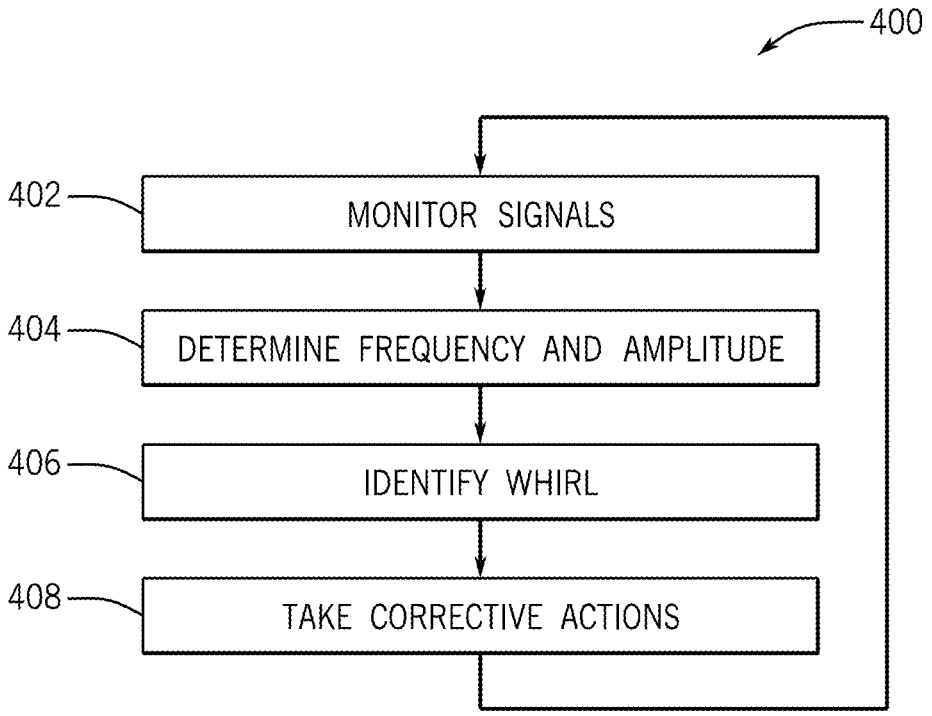
FIG. 4 is a flowchart of an embodiment of a method for identifying and mitigating whirl within a drilling system, in accordance with aspects of the present disclosure.

FIG. 4 is a flowchart of an embodiment of a method 400 for identifying and mitigating whirl within a drilling system, such as the drilling system 10. The method 400 may be performed by the control unit 39, by the steering control unit 90, by one or more other suitable controllers, or a combination thereof. For purposes of this discussion, certain techniques for identifying and/or mitigating whirl in the drilling system 10 may be more suitable for control at the surface 16 by the control unit 39, whereas other techniques for identifying and/or mitigating whirl in the drilling system 10 may be more suitable for control downhole by the steering control unit 90 or some other suitable downhole control unit. Additionally, some techniques may rely upon both surface control by the control unit 39 in conjunction with downhole control by a downhole control unit such as steering control unit 90. Accordingly, the processes discussed in FIG. 4 may be implemented in any suitable combination of hardware, software, firmware, sensors, actuators, etc.

At block 402, signals from the sensors 35 are monitored. As mentioned above, the sensors 35 may include one or more accelerometers and/or one or more gyroscopes. Each accelerometer may monitor linear acceleration, including lateral and/or radial acceleration, caused by a change in linear speed of the drill string 18 and/or the BHA 34 of the drill string 18. Each gyroscope may monitor rotational acceleration (e.g., angular acceleration) of the drill string 18 and/or the BHA 34 of the drill string 18 with respect to one or more axes.

At block 404, the frequency is determined based on the signals from the sensors 35. The frequency may be determined by transforming the acceleration data into a frequency domain representation. Transformation methods may include a Fourier analysis or wavelet analysis. The transformation may be used to determine the dominant frequency/frequencies present in the acceleration data. In another nonlimiting embodiment, the amplitude of each frequency may also be determined by the transformation of the acceleration data. The amplitude corresponds to the magnitude of the vibration.

At block 406, whirl is identified after determining the frequency and/or the amplitude. For example, in certain embodiments, during operation of the drilling system, one or more portions of the drill string 18 (e.g., one or more components of the BHA 34, the reamer 50, etc.) may contact the subterranean formation and/or the casing within the borehole, thereby inducing a vibration within the drill string 18. Whirl may be identified based on the amplitude of the vibrations of each contact and/or the number of the contacts over a period of time. For example, whirl may be identified if the amplitude of the vibrations exceeds a threshold value, and/or whirl may be identified if the number of contacts (e.g., in which the amplitude of vibrations caused by each contact exceeds a threshold value) over a period of time exceeds a threshold number. Furthermore, as discussed in detail below, in certain embodiments, whirl may be identified in response to determining the difference between a frequency at one axial location along the drill string 18 measured by one sensor 35 and a frequency at another axial location along the drill string 18 measured by another sensor 35 is greater than a threshold value.

At block 408, once whirl is identified (e.g., detected), corrective actions may be taken to mitigate the whirl. In certain embodiments, a corrective action may be recommended to the operator or the corrective action may be automatically performed, wherein the type of corrective action that is recommended and/or automatically performed may be based on the amplitude and frequency determinations. For example, the type of corrective action may be based on a difference between the number of contacts and the threshold number, the amplitude of the vibrations caused by contact and the threshold value, or the magnitude of the difference between the frequencies at the different locations along the drill string 18.

In certain embodiments, the corrective action includes introducing noise to the drilling system to convert backward whirl into stable rotation or forward whirl, thereby tending to increase the longevity and/or stability of the drill string 18 and/or BHA 34. The noise may be introduced at the surface 16 by controlling the motor 38, thereby adjusting the rotational speed of the drill string 18 and the BHA 34. Changing the rotational speed of the motor, even for a very short period of time, e.g., a few seconds, can introduce enough noise into the drill string 18 to disrupt the whirl. In addition, the noise may be introduced at the surface 16 by modulating the drilling fluid pump 22 and/or a bypass flow control. Additionally or alternatively, noise may be introduced downhole by controlling the steering pad assembly 54. For example, the steering pad assembly 54 may be controlled to vary the rotational friction of the BHA 34 to add torsional noise to the drilling system 10. Individual mud control valves 102 may be controlled to control respective steering pad actuators 104, thereby controlling each steering pad of the steering pad assembly 54.

The corrective action may also include controlling the MWD modulator 41. The MWD modulator 41 may be used to perturb the flow into the mud motor 96 and/or the flow of mud to the surface 16 to induce noise into the drilling system 10 to counteract the sensed whirl. In addition or alternatively, changing the flow path below the mud motor 96 either with a bypass or a flow modulator may have a similar effect, or if the mud motor 96 has a hollow rotor, changing the flow path may be used with a valve to modulate the bypass flow.

The corrective action may include modulating the rotary speed of the drill string 18 and/or the BHA 34 through perturbation of Weight-on-Bit (WOB). The WOB controls the downward force placed on the drill bit 20 during drilling operations. Varying the WOB may induce torque within the drill string 18 and/or the BHA 34 and cause a transient speed modulation.

Accordingly, multiple mitigation techniques, some of which are described in greater detail with reference to FIGS. 6, 7 and 8, may be used to introduce noise to the drilling system 10. The mitigation techniques may include manipulating variables such as weight on bit, rotation speed, and drilling fluid properties to substantially reduce or eliminate whirl (e.g., backward whirl). A closed loop control system may be implemented to detect the whirl and to mitigate the whirl (e.g., backward whirl). Each mitigation technique may be monitored for effectiveness and repeated if the whirl is not substantially reduced or eliminated.

Figure 5:
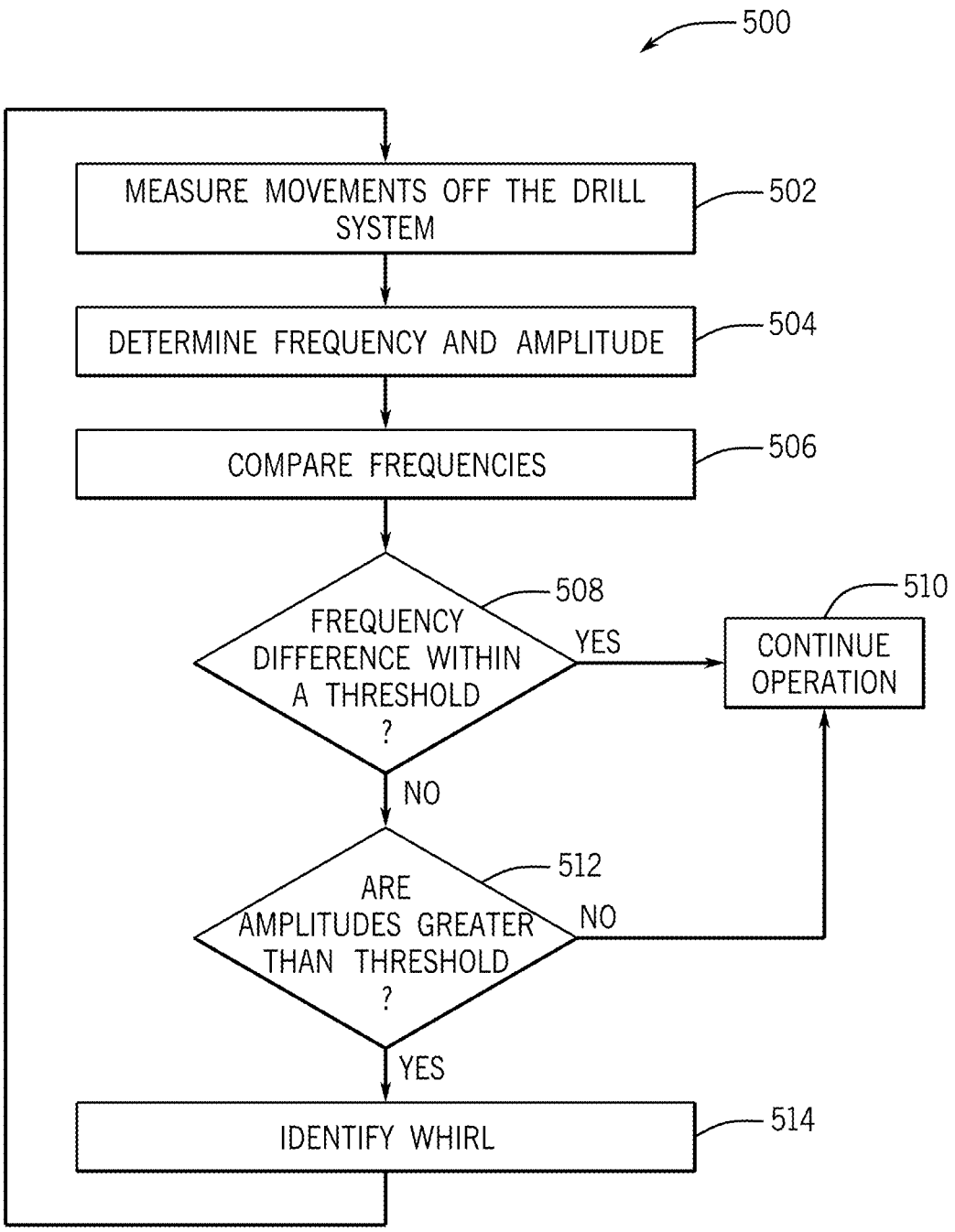
FIG. 5 is a flowchart of an embodiment of a method for identifying the whirl, in accordance with aspects of the present disclosure.

FIG. 5 is a flowchart of an embodiment of a method 500 for identifying the whirl. The method 500 may be performed by the control unit 39 on the surface 16, by the steering control unit 90, by one or more other suitable controllers, or a combination thereof. Furthermore, the steps of the method 500 may be performed in the order disclosed below or in any other suitable order. In certain embodiments, one or more steps of the method 500 may be omitted, and/or the method may include one or more additional steps.

At block 502, movements of the drilling system 10 are measured. For example, if the sensors 35 are accelerometers, accelerations are measured at multiple locations along the axial extent of the drill string 18 and/or BHA 34. The accelerations may be measured in the lateral and/or radial direction. Additionally or alternatively, if some or all of the sensors 35 are gyroscopes, the rotational speed of the drill string 18 and/or BHA 34 is measured at multiple locations along the axial extent of the drill string 18 and/or BHA 34.

At block 504, the frequency and amplitude of each signal from the sensors 35 is determined. The frequency and amplitude may be determined, for example, by transforming the data from sensors 35 into a frequency domain representation. The transformation may include a Fourier analysis or a wavelet analysis. For example, data may be transformed via a Fast Fourier Transform (FFT). In certain embodiments, the frequency of each signal may correspond to the frequency having the highest amplitude within the transformation. In addition, the amplitude of the signal may correspond to the highest amplitude.

At block 506, the frequency at one axial position along the drill string 18 and/or BHA 34 is compared to the frequency at another axial position along the drill string 18 and/or BHA 34. At block 508, a determination is made regarding whether the frequency difference is within a threshold of acceptability. At block 510, if the frequency difference is within the threshold, the operation continues. In certain embodiments, the threshold may be determined based on engineering models of stress and fatigue, as well as historical field data of tool wear (e.g. using guided statistics and/or artificial intelligence (AI)).

In certain embodiments, if the frequency difference indicates that the measured frequencies are multiples or harmonics of the same fundamental frequency, then such a difference is discounted such that the frequency difference is determined to be within the threshold due to the situation being unlikely to indicate an undesirable whirl. However, if the frequency difference indicates that different portions of the drill string 18 and/or BHA 34 are operating at different non-harmonic frequencies, then the frequency difference, if large enough, e.g., greater than 5 percent, greater than 10 percent, greater than 15 percent, greater than 20 percent, greater than 25 percent, greater than 30 percent, etc., is determined not to be within the threshold as being likely to indicate an undesirable whirl.

If the frequency difference indicates that an undesirable whirl may be present in the drill string 18 or BHA 34, in block 512 the amplitudes of the compared frequencies are compared to an amplitude threshold. If the amplitudes are lower than the amplitude threshold, then the magnitude of any whirl is deemed to be low enough so as not to cause any undesirable consequences, so that normal drilling operations may continue in block 510. However, if the amplitudes are above the amplitude threshold, then the magnitude of the whirl is deemed to be significant enough to warrant intervention or mitigation, so a whirl is thus identified in block 514. Accordingly, mitigation actions may be recommended and/or automatically performed as described herein.

Figure 6:
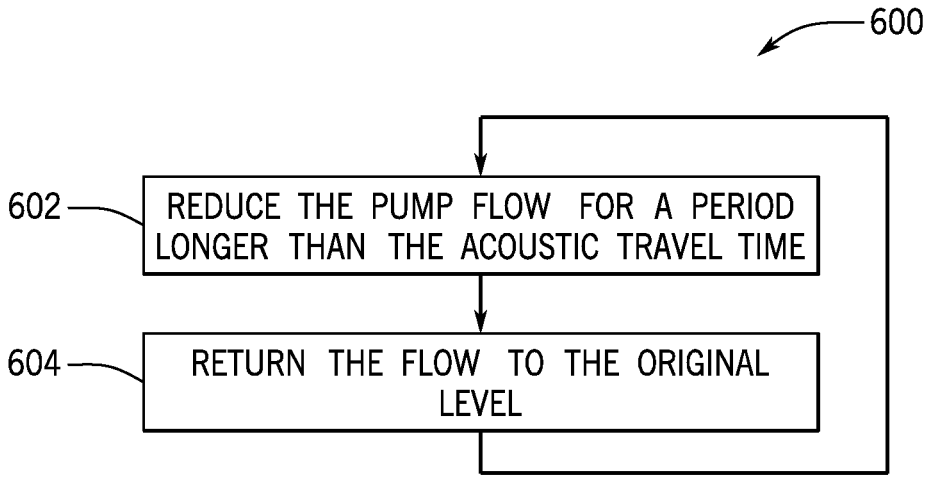
FIG. 6 is a flowchart of one embodiment of a method for mitigating the whirl from a surface for a motor driven assembly, in accordance with aspects of the present disclosure.

FIG. 6 is a flowchart of an embodiment of a method 600 for mitigating the whirl from a surface for a motor driven assembly. The method 600 may be performed by the control unit 39 and/or by one or more other suitable controllers. In addition, in certain embodiments, the method may include one or more additional steps.

At block 602, after detecting whirl, e.g., using the method 500 or by any other suitable method, the pump 22 may reduce flow of drilling mud for a period longer than the acoustic travel time from the pump 22 to the mud motor 96 or drill bit 20. For example, the reduction in flow may take place for one, two or three times the acoustic travel time, so long as the period is long enough to introduce noise into the drilling system 10 in an effort to mitigate the detected whirl. The operating speed of the pump 22 can be reduced using Variable Frequency Drives (VFDs) or the motor 38, for example. Alternatively, the pump flow can be decreased by adjusting a valve (not shown) on the outlet of the pump 22 or by decreasing the flow with a worm drive clamp (not shown), for example. At block 604, the pump flow returns to its original level. At this point, a method for detecting whirl, such as method 500, may be performed again to determine if the mitigation efforts of method 600 have been effective. If not, method 600 may be performed again, and possibly for a different time period, until the detected whirl has been mitigated.

In alternative embodiments, at block 602, drilling fluid flow from the pump 22 may be decreased to a level to trigger a micro stall of the mud motor 96. This period is typically longer than the acoustic travel time from the pump 22 to the mud motor 96, but it is also typically a larger reduction in pump flow than discussed above since it is sufficient basically to starve the mud motor 96 of enough drilling mud to cause a micro stall, e.g., a short period stall, of the mud motor 96. The micro stall of the mud motor 96 may generate a pressure spike in the drilling fluid inside the drill string 18. Such a pressure spike typically propagates up to the top of the drill string 18 and is reflected back as a further pressure rise. As the further pressure rise reaches the top of the mud motor 96, a restart of the mud motor 96 may be triggered. As such the mud motor 96 may be stationary for a few seconds. Such a transient may disrupt the whirl (e.g., backward whirl), thereby returning the drilling system 10 to stable operation. A micro stall may also be induced by increasing stick and slip or by reducing the speed of the surface motor 38. At block 604, the pump flow returns to its original level. At this point, a method for detecting whirl, such as method 500, may be performed again to determine if the mitigation efforts of method 600 have been effective. If not, method 600 may be performed again, and possibly for a different time period, until the detected whirl has been mitigated. It should be noted that either method discussed relative to block 602 may be used alone or in conjunction with one another.

Figure 7:
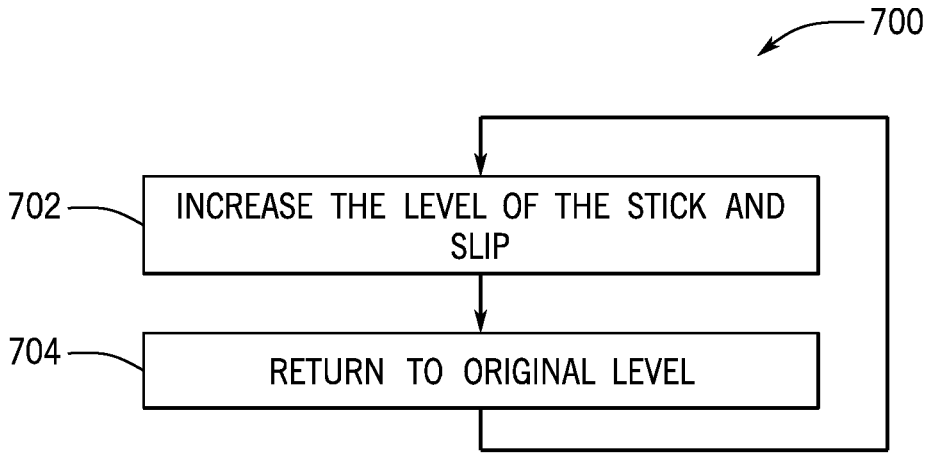
FIG. 7 is a flowchart of another embodiment of a method for mitigating the whirl from the surface for a rotary assembly, in accordance with aspects of the present disclosure.
Figure 8:
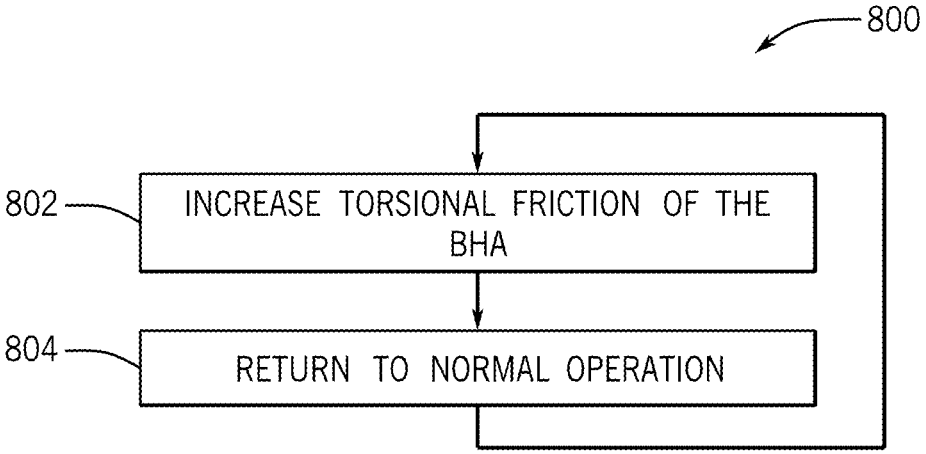
FIG. 8 is a flowchart of an embodiment of a method for mitigating the whirl from downhole, in accordance with aspects of the present disclosure.

FIG. 7 is a flowchart of an embodiment of a method 700 for mitigating the whirl from the surface for a rotary assembly. The method 700 may be performed by the control unit 39 at the surface 16 and/or by one or more other suitable controllers. In certain embodiments, the method 700 may include one or more additional steps.

At block 702, after detecting whirl, e.g., using the method 500 or by any other suitable method, the whirl may be mitigated from the surface 16 by adjusting the top drive speed and/or changing the top drive operation, e.g., by adjusting the speed of the motor 38, to increase the level of stick and slip. Stick and slip refers to a situation where the drill bit 20 and/or the BHA 34, intermittently stick and slip due to friction and torque variations. For example, the drill bit 20 can momentarily stick or become stationary at the bottom of the borehole 26, then suddenly accelerate or slip once enough torque builds up to cause it to rotate again. While such stick and slip is typically avoided as it tends to result in decreased rate of penetration and unwanted torque or shock being sent through the drilling system 10, it may be advantageous to induce some amount of stick and slip to introduce noise, e.g., torque or shock, into the drilling system 10 to mitigate any detected whirl. For example, stick and slip may be induced by reducing the top drive speed and/or by adjusting WOB. WOB can be adjusted, for example, manually by a drill worker using drawworks or automatically by well-known control systems. In one example, the WOB may be pulsed at a frequency close to the fundamental frequency for stick and slip.

At block 704, the stick and slip returns to its original level. At this point, a method for detecting whirl, such as method 500, may be performed again to determine if the mitigation efforts of method 700 have been effective. If not, method 700 may be performed again, and possibly for a different time period, until the detected whirl has been mitigated. It should also be noted that any of the mitigation methods discussed herein can be used alone or in conjunction with one another. In other words, if one mitigation method is not mitigating the whirl, another mitigation method may be used.

Although the previous mitigation methods 600 and 700 have described methods that are typically controlled at the surface 16, some mitigation methods may be controlled downhole. FIG. 8 is a flowchart of an embodiment of a method for mitigating the whirl from downhole. The method 800 may be performed by the steering control unit 90 and/or by one or more other suitable controllers. In certain embodiments, the method 800 may include one or more additional steps.

At block 802, after detecting whirl, e.g., using the method 500 or by any other suitable method, the whirl may be mitigated downhole by increasing the torsion friction of the BHA 34 to introduce noise into the drilling system 10. For example, the steering control unit 90 can temporarily extend the steering pads of the steering assembly 54 to increase torsional friction and, thus, induce torque into the BHA 34 and/or the drill string 18. For example, extending the steering pads applies lateral force against the borehole wall, which increases torsional friction to momentarily disrupt the BHA 34 from oscillating in a circular motion. As a result, the oscillation associated with the whirl may be disrupted, thereby substantially reducing or eliminating the whirl.

Alternatively, the rotary speed of the drill bit 20 can be changed or stick-slip can be triggered by the steering control unit 90 adjusting the mud motor 96 to mitigate whirl. The rotary speed mitigates whirl in downhole tools by impacting the dynamic forces and contact behavior within the drilling system 10. For example, a higher rotary speed can result in a change to the dominant vibration mode, and mitigate whirl by triggering stick-slip vibrations instead, or by changing the geometry of the drill string 18. This may be accomplished, for example, by the steering control unit 90 actuating a bypass on the mud motor 96 to trigger motor micro stall or perturb the motor speed.

At block 804, the drill system 14 returns to normal operation. At this point, a method for detecting whirl, such as method 500, may be performed again to determine if the mitigation efforts of method 800 have been effective. If not, method 800 may be performed again, and possibly for a different time period, until the detected whirl has been mitigated. It should also be noted that any of the mitigation methods discussed herein can be used alone or in conjunction with one another. In other words, if one mitigation method is not mitigating the whirl, another mitigation method may be used.

Various technical problems relate to undesirable whirl in the drilling system 10 that can lead to a decrease in drilling efficiency and possibly damage to various components of the drilling system 10. Various technical effects or advantages of the disclosed embodiments may include monitoring and analyzing characteristics of the drilling system 10 to quantify and/or detect any undesirable operations, such as whirl, and employing mitigation techniques, including various techniques for introducing noise into the drilling system 10, to reduce or eliminate such undesirable operations, e.g., to reduce or eliminate any detected whirl. For example, steering pads may be extended to induce torque on the drill string to mitigate the whirl, a fluid flow rate from a drilling fluid pump may be perturbed to induce noise into the drill string to mitigate the whirl, a rotational speed of the drill string may be adjusted to increase a level of stick and slip of the BHA to induce noise into the drill string to mitigate the whirl, or a combination thereof.

The subject matter described in detail above may be defined by one or more clauses, as set forth below.

A system includes a plurality of sensors placed at various axial positions on a drill string and configured to output respective signals indicative of movement of the drill string, and one or more controllers communicatively coupled to the plurality of sensors. The one or more controllers are configured to identify whirl in the drill string based on the respective signals from the plurality of sensors. The one or more controllers are further configured to control a downhole component, a surface component, or a combination thereof, in response to identifying the whirl, to introduce noise into the drill string to mitigate the whirl without removing the drill string from a bottom of a borehole and without terminating all rotation of the drill string.

The system of the preceding clause, wherein the plurality of sensors include accelerometers, gyroscopes, or a combination thereof.

The system of any preceding clause, wherein the one or more controllers identify whirl in the drill string by determining a frequency component and an amplitude component of each sensor signal, comparing a difference of at least two of the frequency components to a threshold, if the frequency difference exceeds the threshold, comparing at least two of the respective amplitude components to an amplitude threshold, and identifying a whirl if the at least two amplitude components exceed the amplitude threshold.

The system of any preceding clause, wherein the one or more controllers include a surface control unit configured to be positioned above a ground surface and a steering control unit configured to be disposed within a bottom hole assembly (BHA).

The system of any preceding clause, wherein the BHA includes a steering pad assembly having steering pad actuators configured to extend and retract steering pads of the BHA, and wherein, in response to identifying whirl, the steering control unit is configured to control the steering pad actuators to extend the steering pads to induce torque on the drill string to mitigate the whirl.

The system of any preceding clause, wherein the surface component includes a drilling fluid pump, and wherein, in response to identifying whirl, the surface control unit is configured to control the drilling fluid pump to perturb a fluid flow rate from the drilling fluid pump to induce noise into the drill string to mitigate the whirl.

The system of any preceding clause, wherein the fluid flow rate is reduced for a period of time longer than an acoustic travel time between the drilling fluid pump and the BHA.

The system of any preceding clause, wherein the BHA includes a mud motor communicatively coupled to the drilling fluid pump, and wherein the fluid flow rate is reduced to cause a micro stall in the mud motor to induce noise into the drill string to mitigate the whirl.

The system of any preceding clause, wherein the surface component includes a motor controlled by the surface control unit and configured to rotate the drill string and the BHA, and wherein, in response to identifying whirl, the surface control unit controls the motor to adjust its rotational speed of the drill string to increase a level of stick and slip of the BHA to induce noise into the drill string to mitigate the whirl.

A method of identifying and mitigating whirl within a drilling system. The method includes monitoring signals from a plurality of sensors positioned at various axial locations along a drill string of the drilling system, determining a respective frequency component and a respective amplitude component for each of the signals, and identifying whirl in the drill string based on at least two of the respective frequency components and their respective amplitude components. The method further includes mitigating the whirl by introducing noise into the drilling system to reduce or eliminate the whirl without removing the drill string from a bottom of a borehole and without terminating all rotation of the drill string.

The method of the preceding clause, wherein the plurality of sensors includes accelerometers, gyroscopes or any combination thereof.

The method of any preceding clause, wherein identifying the whirl includes comparing a difference of at least two of the frequency components to a threshold, if the frequency difference exceeds the threshold, comparing at least two of the respective amplitude components to an amplitude threshold, identifying the whirl if the at least two amplitude components exceed the amplitude threshold.

The method of any preceding clause, wherein mitigating the whirl includes controlling a steering pad assembly of a bottom hole assembly (BHA) of the drill string to extend steering pads of the steering pad assembly to induce torque on the drill string to mitigate the whirl.

The method of any preceding clause, wherein mitigating the whirl includes controlling a drilling fluid pump communicatively coupled to the drill string to perturb a fluid flow rate from the drilling fluid pump to induce noise into the drill string to mitigate the whirl.

The method of any preceding clause, including reducing the fluid flow rate for a period of time longer than an acoustic travel time between the drilling fluid pump and a bottom hole assembly (BHA) of the drill string.

The method of any preceding clause, including reducing the fluid flow rate to a mud motor of the BHA that is communicatively coupled to the drilling fluid pump to cause a micro stall in the mud motor to induce noise into the drill string to mitigate the whirl.

The method of any preceding clause, wherein mitigating the whirl includes adjusting rotational speed of the drill string to increase a level of stick and slip of a drill bit of the drill string to induce noise into the drill string to mitigate the whirl.

The method of any preceding clause, wherein mitigating the whirl includes adjusting weight on bit (WOB) of a drill bit of the drill string to increase a level of stick and slip of the drill bit to induce noise into the drill string to mitigate the whirl.

The method of any preceding clause, wherein introducing noise into the drilling system includes a short term disturbance of the drilling system.

The method of any preceding clause, including returning the drilling system to normal operation after mitigating the whirl.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the steps of the methods described herein are illustrated and described may be re-arranged, and/or two or more steps may occur simultaneously. The embodiments were chosen and described in order to best explain the principles of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a plurality of sensors placed at various axial positions on a drill string and configured to output respective sensor signals indicative of movement of the drill string; and at least one controller communicatively coupled to the plurality of sensors, wherein the at least one controller is configured to:

a) identify whirl in the drill string by operations that include i) determining frequency components and corresponding amplitude components for the sensor signals;

ii) comparing a first frequency component of the frequency components of i) to a second frequency component of the frequency components of i), wherein the first and second frequency components are based on the sensor signals produced by the plurality of sensors at different axial positions on the drill string;

iii) determining if a frequency difference between the first frequency component and the second frequency component of ii) exceeds a frequency threshold;

iv) if the frequency difference between the first frequency component and the second frequency component is determined to exceed the frequency threshold in iii), comparing both a first amplitude component of the amplitude components of i) and a second amplitude component of the amplitude components of i) to an amplitude threshold, wherein the first amplitude component corresponds to the first frequency component of ii) and the second amplitude component corresponds to the second frequency component of ii); and v) identifying whirl in the drill string if both the first and second amplitude components exceed the amplitude threshold of iv); and b) control a downhole component, a surface component, or a combination thereof, in response to identifying the whirl, to introduce noise into the drill string to mitigate the whirl without removing the drill string from a bottom of a borehole and without terminating all rotation of the drill string.

2. The system of claim 1, wherein the plurality of sensors comprise accelerometers, gyroscopes, or a combination thereof.

3. The system of claim 1, wherein the at least one controller is configured to not identify whirl in the drill string if the frequency difference between the first frequency component and the second frequency component of ii) indicates that the frequency components are multiples or harmonics of the same fundamental frequency.

4. The system of claim 1, wherein the at least one controller comprises a surface control unit positioned above a ground surface and a steering control unit disposed within a bottom hole assembly (BHA).

5. The system of claim 4, wherein the BHA comprises a steering pad assembly having steering pad actuators configured to extend and retract steering pads of the BHA, and wherein the control of b) comprises the steering control unit controlling the steering pad actuators to extend the steering pads to induce torque on the drill string to mitigate the whirl.

6. The system of claim 4, wherein the control of b) comprises the surface control unit controlling a surface-located drilling fluid pump to perturb a fluid flow rate from the drilling fluid pump to induce noise into the drill string to mitigate the whirl.

7. The system of claim 6, wherein the BHA comprises a mud motor communicatively coupled to the drilling fluid pump, and wherein the control of b) controls to the drilling fluid pump to reduce the fluid flow rate to cause a stall in the mud motor to induce noise into the drill string to mitigate the whirl.

8. The system of claim 4, wherein the surface component comprises a surface-located motor controlled by the surface control unit and configured to rotate the drill string and the BHA, wherein the control of b) controls the surface-located motor to adjust rotational speed of the drill string and the BHA to induce noise into the drill string to mitigate the whirl.

9. A method of identifying and mitigating whirl within a drilling system, the method comprising:

a) monitoring sensor signals from a plurality of sensors positioned at various axial locations along a drill string of the drilling system;

b) determining frequency components and corresponding amplitude components for the sensor signals;

c) identifying whirl in the drill string by operations that include i) comparing a first frequency component of the frequency components of b) to a second frequency component of the frequency components of b), wherein the first and second frequency components are based on the sensor signals produced by the plurality of sensors at different axial positions on the drill string;

ii) determining if a frequency difference between the first frequency component and the second frequency component of i) exceeds a frequency threshold;

iii) if the frequency difference between the first frequency component and the second frequency component is determined to exceed the frequency threshold in ii), comparing both a first amplitude component of the amplitude components of b) and a second amplitude component of the amplitude components of b) to an amplitude threshold, wherein the first amplitude component corresponds to the first frequency component of i) and the second amplitude component corresponds to the second frequency component of i); and iv) identifying whirl in the drill string if both the first and second amplitude components exceed the amplitude threshold of iii); and d) mitigating the whirl by introducing noise into the drilling system to reduce or eliminate the whirl without removing the drill string from a bottom of a borehole and without terminating all rotation of the drill string.

10. The method of claim 9, wherein the plurality of sensors comprises accelerometers, gyroscopes or any combination thereof.

11. The method of claim 9, wherein whirl in the drill string is not identified if the frequency difference between the first frequency component and the second frequency component of i) indicates that the frequency components are multiples or harmonics of the same fundamental frequency.

12. The method of claim 9, wherein mitigating the whirl in d) comprises:

controlling a steering pad assembly of a bottom hole assembly (BHA) of the drill string to extend steering pads of the steering pad assembly to induce torque on the drill string to mitigate the whirl.

13. The method of claim 9, wherein mitigating the whirl in d) comprises:

controlling a drilling fluid pump communicatively coupled to the drill string to perturb a fluid flow rate from the drilling fluid pump to induce noise into the drill string to mitigate the whirl.

14. The method of claim 13, further comprising reducing the fluid flow rate to a mud motor of a bottom hole assembly (BHA) that is communicatively coupled to the drilling fluid pump to cause a stall in the mud motor to induce noise into the drill string to mitigate the whirl.

15. The method of claim 9, wherein mitigating the whirl in d) comprises:

adjusting rotational speed of the drill string to induce noise into the drill string to mitigate the whirl.

16. The method of claim 9, wherein mitigating the whirl in d) comprises:

adjusting weight on bit (WOB) of a drill bit of the drill string to induce noise into the drill string to mitigate the whirl.

17. The method of claim 9, wherein introducing noise into the drilling system comprises a disturbance of the drilling system.

18. The method of claim 9, further comprising returning the drilling system to normal operation after mitigating the whirl.

* * * * *